US007097083B2

(12) United States Patent
Kolodziej et al.

(10) Patent No.: US 7,097,083 B2
(45) Date of Patent: Aug. 29, 2006

(54) CAGE AND OFFSET UPPER PROBE ASSEMBLY FOR FASTENER-DRIVING TOOL

(75) Inventors: Norbert K. Kolodziej, Park Ridge, IL (US); Yongping Gong, Glenview, IL (US); Kevin M. Tucker, Chicago, IL (US); Cheryl L. Panasik, Elburn, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/931,351

(22) Filed: Sep. 1, 2004

(65) Prior Publication Data

US 2006/0043139 A1 Mar. 2, 2006

(51) Int. Cl.
*B25C 1/04* (2006.01)

(52) U.S. Cl. ..... 227/8; 227/130

(58) Field of Classification Search ..... 227/8, 227/10, 130, 142

See application file for complete search history.

(56) References Cited

U.S. PATENT DOCUMENTS 4,483,474 A * 11/1984 Nikolich ..... 227/8
4,522,162 A 6/1985 Nikolich
5,197,646 A 3/1993 Nikolich
5,558,264 A 9/1996 Weinstein
5,909,836 A * 6/1999 Shkolnikov et al. ..... 227/8
6,138,887 A * 10/2000 Nayrac et al. ..... 227/8
6,145,724 A 11/2000 Shkolnikov et al.
6,311,887 B1 * 11/2001 Walter ..... 227/10
2003/0034377 A1 2/2003 Porth et al.
2005/0189390 A1 * 9/2005 Taylor et al. ..... 227/8

FOREIGN PATENT DOCUMENTS

EP 0 560 049 9/1993
EP 0 738 565 10/1996

* cited by examiner

*Primary Examiner*—Scott A. Smith
(74) *Attorney, Agent, or Firm*—Greer, Burns & Crain, Ltd.; Lisa M. Soltis; Mark W. Croll

(57) ABSTRACT

A cage and upper probe assembly for use in a fastener-driving tool includes a cage including a base and a plurality of arms configured for attachment to a valve sleeve, a probe configured for direct attachment to the cage and having at least one lobe formation for receiving an impact operationally generated by a pusher rod, and the probe being attached to the cage so that the impact of the pusher rod upon the probe is directly transmitted to the cage.

12 Claims, 2 Drawing Sheets

CAGE AND OFFSET UPPER PROBE ASSEMBLY FOR FASTENER-DRIVING TOOL

BACKGROUND

The present invention relates generally to fastener-driving tools used to drive fasteners into workpieces, and specifically to combustion-powered fastener-driving tools, also referred to as combustion tools.

Combustion-powered tools are known in the art, and one type of such tools, also known as IMPULSE® brand tools for use in driving fasteners into workpieces, is described in commonly assigned patents to Nikolich U.S. Pat. Re. No. 32,452, and U.S. Pat. Nos. 4,522,162; 4,483,473; 4,483,474; 4,403,722; 5,197,646; 5,263,439 and 6,145,724, all of which are incorporated by reference herein. Similar combustion-powered nail and staple driving tools are available commercially from ITW-Paslode of Vernon Hills, Ill. under the IMPULSE®, BUILDEX®□ and PASLODE® brands.

Such tools incorporate a tool housing enclosing a small internal combustion engine. The engine is powered by a canister of pressurized fuel gas, also called a fuel cell. A battery-powered electronic power distribution unit produces a spark for ignition, and a fan located in a combustion chamber provides for both an efficient combustion within the chamber, while facilitating processes ancillary to the combustion operation of the device. Such ancillary processes include: inserting the fuel into the combustion chamber; mixing the fuel and air within the chamber; and removing, or scavenging, combustion by-products. The engine includes a reciprocating piston with an elongated, rigid driver blade disposed within a single cylinder body.

The combustion engine includes a reciprocating piston with an elongated, rigid driver blade disposed within a cylinder body. A valve sleeve is axially reciprocable about the cylinder and, through a linkage, moves to close the combustion chamber when a workpiece contact element (WCE) at the end of the linkage is pressed against a workpiece. This pressing action also triggers a fuel metering valve to introduce a specified volume of fuel into the closed combustion chamber.

Upon the pulling of a trigger switch, which causes the spark to ignite a charge of gas in the combustion chamber of the engine, the combined piston and driver blade is forced downward to impact a positioned fastener and drive it into the workpiece. The piston then returns to its original, or pre-firing position, through differential gas pressures within the cylinder. Fasteners are fed magazine-style into the nosepiece, where they are held in a properly positioned orientation for receiving the impact of the driver blade.

In many types of combustion tools, the WCE includes a pusher rod which reciprocates with the WCE relative to a nosepiece fixed to the tool. As the tool is depressed against the workpiece, causing movement of the WCE relative to the tool nosepiece, an upper end of the pusher rod impacts a cage assembly, which is ultimately connected to the valve sleeve. To reduce impact damage to the cage assembly through repeated use, a rubber-like grommet was placed at the impact point of the pusher rod. Disadvantages of that arrangement included that the grommet deteriorated relatively quickly compared to the useful life of the tool, and that the shock-absorbing function of the grommet resulted in inefficiency through lost motion and extra play in the system.

Thus, there is a need for a cage and probe assembly for a combustion-powered fastener-driving tool which addresses the drawbacks of the prior art.

BRIEF SUMMARY

The above-listed needs are met or exceeded by the present cage and probe assembly, designed for use with combustion-powered fastener driving tools. The present cage and probe assembly provides a direct, positive connection between the probe and the cage. As such, the movement of the pusher rod of the WCE is transmitted more efficiently to the valve sleeve. In addition, the probe is made of a rigid material for facilitating the direct transfer of forces. To prevent damage to the probe and cage, the present probe is provided with an axially thickened lobe which withstands repeated impacts from the pusher rod. Thus, the present cage and probe assembly is configured for longterm operation of the type contemplated with typical fastener-driving tools. Another feature is that the lobe is sufficiently offset from an operational axis of the tool so that the operation of the pusher rod is remote from that of the driver blade.

More specifically, a cage and upper probe assembly for use in a fastener-driving tool includes a cage including a base and a plurality of generally normally extending arms configured for attachment to a valve sleeve, a probe configured for direct attachment to the cage and having at least one lobe formation for receiving a pusher rod, and the probe being attached to the cage so that impact of the pusher rod upon the probe is directly transmitted to the cage.

In another embodiment, a combustion-powered fastener-driving tool includes a driver blade, a nosepiece configured for slidably receiving the driver blade, a workpiece contact element reciprocating relative to the nosepiece and a pusher rod secured to the workpiece contact element for common movement. A cage includes a base and a plurality of generally normally extending arms configured for attachment to a valve sleeve. A probe is provided and is configured for direct attachment to the cage and has at least one lobe formation for receiving the pusher rod. The probe is attached to the cage so that impact of the pusher rod upon the probe is directly transmitted to the cage.

DETAILED DESCRIPTION

Figure 1:
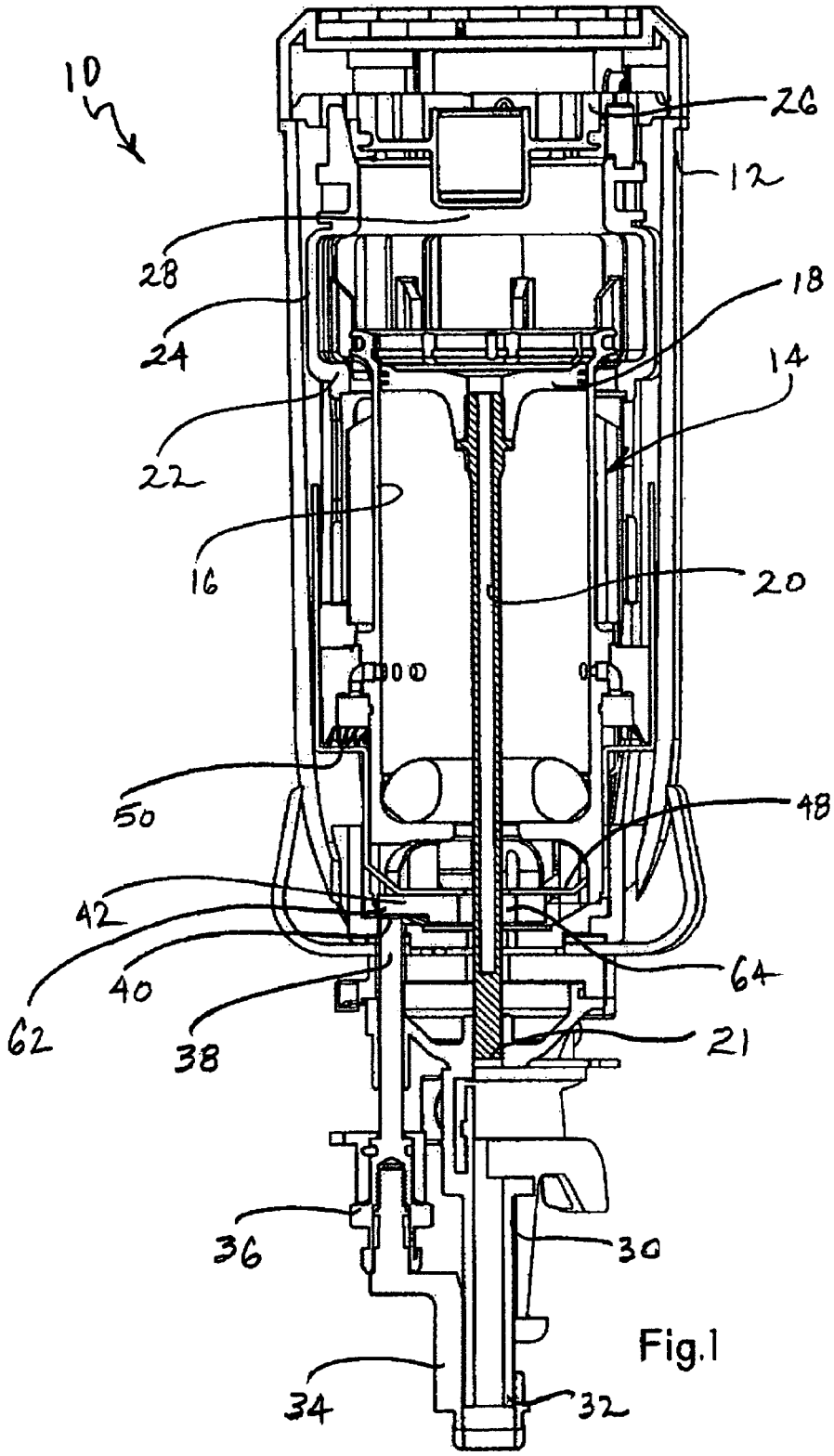
FIG. 1 is a fragmentary front vertical section of a combustion-powered fastener-driving tool incorporating the present cage and upper probe assembly.

Referring now to FIG. 1, a combustion-powered fastener-driving tool is generally designated 10 and includes a main housing 12 enclosing a power source 14. As is known in the art, the power source 14 includes a cylinder 16 defining a reciprocating pathway for a piston 18 to which is attached a driver blade 20. The driver blade 20 has a tip 21 for engaging fasteners and driving them into a workpiece. A valve sleeve 22 surrounds and axially reciprocates relative to the cylinder 16. An upper portion 24 of the valve sleeve, the piston 18 and a cylinder head 26 combine to define a combustion chamber 28.

A nosepiece 30 is secured to the power source 14 and has a workpiece end 32 opposite the power source and configured for being placed nearest a workpiece into which a fastener is to be driven. A workpiece contact element 34 is positioned at the workpiece end 32 and slidingly reciprocates relative to the nosepiece 30 and is biased by a spring (not shown) to an extended position, seen in FIG. 1. As is known in the art, the workpiece contact element 34 has a threadable depth adjuster 36 for adjusting the depth of penetration of driven fasteners. A pusher rod 38 projects vertically relative to the depth adjuster 36 in a direction generally parallel to an operational axis of the driver blade 20. The pusher rod 38 moves in concert with the workpiece contact element 34.

Figure 2:
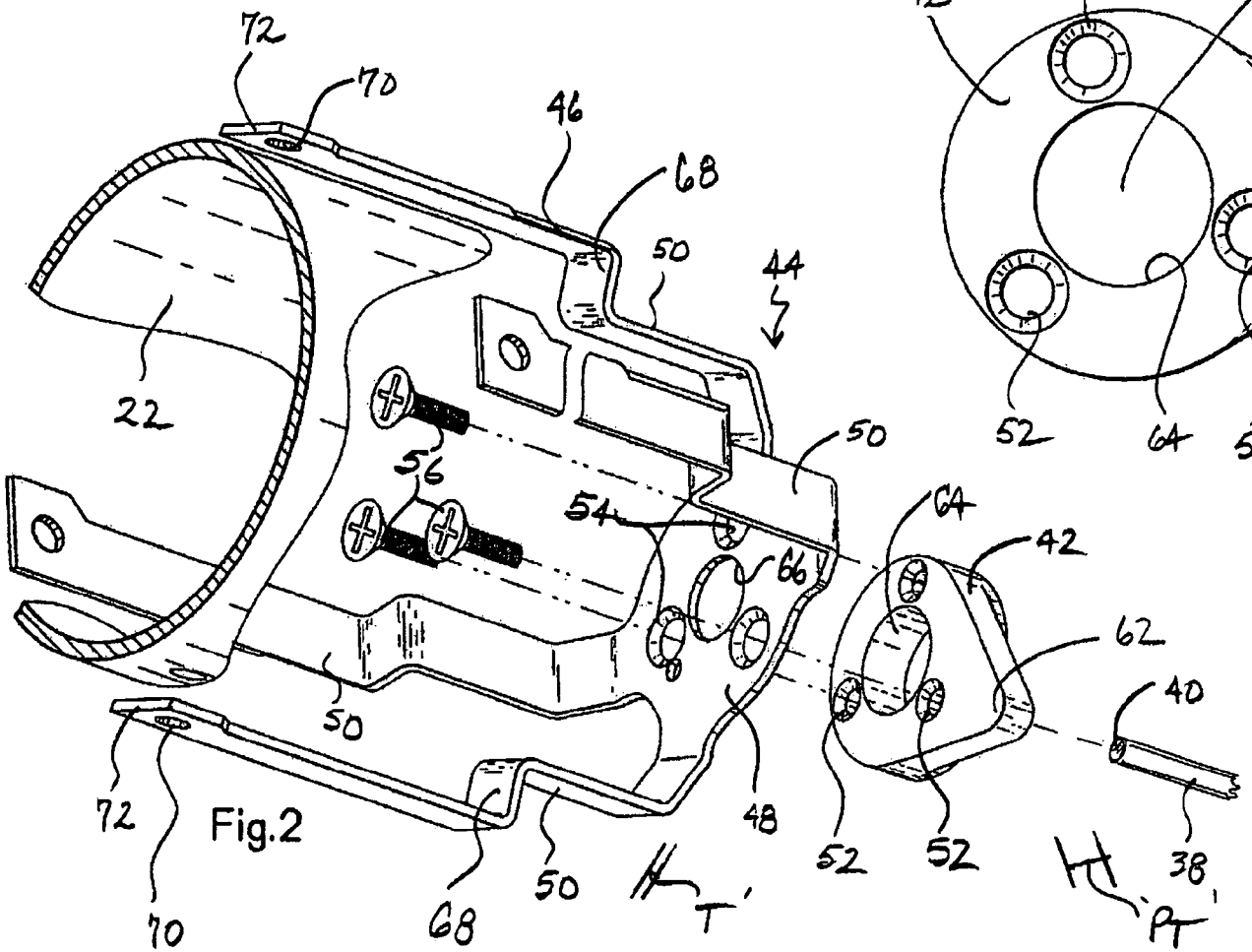
FIG. 2 is an exploded perspective view of the present cage and upper probe assembly with the tool shown fragmentarily.

Referring now to FIGS. 1 and 2, an upper or free end 40 of the pusher rod 38 impacts an upper probe 42 of a cage and upper probe assembly, generally designated 44. The assembly 44 includes the upper probe 42 and a cage 46 including a plate-like base 48 and a plurality of generally normally extending arms 50 configured for attachment to the valve sleeve 22.

A feature of the present assembly 44 is that the upper probe 42 is configured for direct attachment to the cage 46. Such attachment is achieved in the preferred embodiment by at least one and preferably three fastener apertures 52 on the upper probe 42 which are in registry with three fastener apertures 54 on the cage base 48, at least the latter preferably being countersunk. Corresponding threaded fasteners 56 secure the probe 42 and the cage 46 together. Alternative fastening technologies are contemplated, including welding, chemical adhesives and other types of fasteners. Regardless of the type of fastening technology, the probe 42 is attached to the cage 46 so that impact of the pusher rod 38 upon the probe is directly transmitted to the cage.

Figure 3:
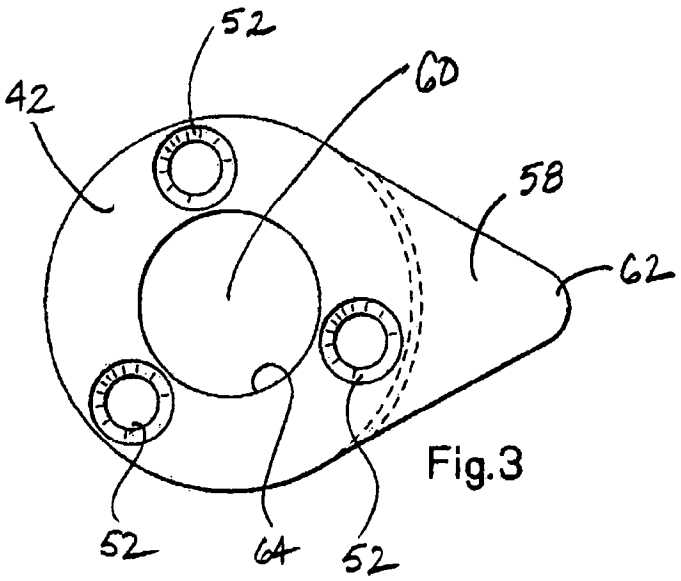
FIG. 3 is a top plan view of the present probe.

Referring now to FIGS. 2 and 3, the upper probe 42 is generally circular when viewed from above, and has at least one lobe formation 58 projecting radially from a center 60 defined by the probe. The lobe formation 58 is constructed and arranged for receiving and engaging the upper end 40 of the pusher rod 38. In the preferred embodiment, for reducing manufacturing cost and facilitating fit within the tool 10, the lobe formation 58 narrows with increasing distance from the center, or in other words is generally wedge-shaped when viewed from above (FIG. 3). A distal end 62 of the lobe formation 58 is configured for engaging the upper end 40 of the pusher rod 38. The lobe formation 58, and especially the distal end 62 is sufficiently offset from an operational axis of the tool exemplified by the path of the driver blade 20 so that the operation of the pusher rod 38 is remote from that of the driver blade.

The upper probe 42 defines a central aperture 64 configured for accommodating the driver blade 20 (best seen in FIG. 1). Also, the base 48 defines a throughbore 66 in communication with, and preferably in registry with the central aperture 64 for receiving the driver blade 20. To withstand repeated impact from the pusher rod 38 encountered through longterm use of the tool 10, the upper probe 42 is axially thickened relative to the base 48. The relative thickening of the upper probe 42 is significant, and in the order of five times a thickness 'T' of the base. In one preferred embodiment, and for purposes of example only, the base thickness 'T' is approximately 0.060 inch and a probe thickness 'PT' is approximately 0.313 inch. Other relative dimensions are contemplated depending on the application. Also, it is contemplated that the lobe formation 58 has a thickness less than the probe thickness PT.

Referring now to FIG. 2, the cage 46 has four arms 50 projecting from the base 48, each arm having a radially extending shoulder 68 and a distal eyelet 70 located at an eyelet end 72 for attachment to the valve sleeve 22. The shoulders 68 are provided to allow the arms 50 to clear internal components of the tool 10. As is known in the art, the arms 50 are provided in a sufficient length to permit the valve sleeve 22 to reciprocate from an open position shown in FIG. 1 to a closed position in which the combustion chamber 28 is sealed.

It will be seen that the present cage and upper probe assembly 44 addresses the drawbacks of the prior art configurations. Motion from the pusher rod 38 is directly transmitted through the probe 42 to the cage 46 and ultimately to the valve sleeve 22. Also, the probe thickness PT is sufficient to withstand the operational impact of the pusher rod 38 over the operational life of the tool 10.

While a particular embodiment of the present cage and upper probe assembly for a fastener-driving tool has been described herein, it will be appreciated by those skilled in the art that changes and modifications may be made thereto without departing from the invention in its broader aspects and as set forth in the following claims.

The invention claimed is:

1. A cage and upper probe assembly for use in a fastener-driving tool, comprising:

a cage including a base and a plurality of arms configured for attachment to a valve sleeve;

a probe configured for direct attachment to said cage and having at least one lobe formation constructed and arranged for receiving an impact operationally generated from reciprocating contact by a pusher rod at a point of said contact, said lobe formation having a solid cross-section throughout; and said probe being attached to said cage so that said impact of the pusher rod upon said probe is directly transmitted to said cage.

2. The probe assembly of claim 1 wherein said probe is generally circular when viewed from above, and said at least one lobe projects radially from a center of said probe.

3. The probe assembly of claim 2 wherein said lobe narrows with increasing distance from said center.

4. The probe assembly of claim 2 wherein said lobe is generally wedge-shaped when viewed from above.

5. The probe assembly of claim 2 wherein said probe defines a central aperture configured for accommodating a driver blade.

6. The probe assembly of claim 5 wherein said base defines a throughbore in communication with said central aperture.

7. The probe assembly of claim 1 wherein said probe is axially thickened relative to said base.

8. The probe assembly of claim 7 wherein said probe has an axial thickness approximately five times a thickness of said base.

9. The probe assembly of claim 1 wherein said cage has four arms projecting from said base, each said arm having a radially extending shoulder and a distal eyelet for attachment to a valve sleeve.

10. The probe assembly of claim 1 wherein said probe is constructed and arranged so that said lobe has a distal end and engages the pusher rod at said distal end.

11. The probe assembly of claim 1 wherein said probe and said base have corresponding fastener apertures for receiving threaded fasteners used to join said probe to said base.

12. A combustion-powered fastener-driving tool, comprising:

a driver blade;

a nosepiece configured for slidably receiving said driver blade;

a workpiece contact element reciprocating relative to said nosepiece;

a pusher rod secured to said workpiece contact element for common movement;

a cage including a base and four arms projecting from said base, each said arm having a radially extending shoulder and a distal eyelet for attachment to a valve sleeve;

a probe configured for direct attachment to said cage and having at least one lobe formation constructed and arranged for receiving a repeated impact operationally generated by reciprocation of said pusher rod, said lobe formation having a surface constructed and arranged for receiving said reciprocating impact from an upper end of said pusher rod; and said probe being attached to said cage and movable independent of said pusher rod.

* * * * *